US006408232B1

(12) United States Patent
Cannon et al.

(10) Patent No.: US 6,408,232 B1
(45) Date of Patent: Jun. 18, 2002

(54) WIRELESS PICONET ACCESS TO VEHICLE OPERATIONAL STATISTICS

(75) Inventors: Joseph M. Cannon, Harleysville; James A. Johanson, Macungie; Philip D. Mooney, North Wales, all of PA (US)

(73) Assignee: Agere Systems Guardian Corp., Orlando, FL (US)

( * ) Notice: Subject to any disclaimer, the term of this patent is extended or adjusted under 35 U.S.C. 154(b) by 0 days.

(21) Appl. No.: 09/551,553

(22) Filed: Apr. 18, 2000

(51) Int. Cl.[7] ..... G08G 1/09

(52) U.S. Cl. ..... 701/29; 115/117; 115/33; 340/991; 340/933; 370/328; 123/493

(58) Field of Search ..... 701/29, 101, 115, 701/117, 102, 114, 33; 340/348, 825.34, 991, 933; 455/546; 370/328, 401; 123/493

(56) References Cited

U.S. PATENT DOCUMENTS

| | | | | |
|---|---|---|---|---|
| 5,157,610 A | * | 10/1992 | Asano et al. | 364/424.03 |
| 5,758,300 A | * | 5/1998 | Abe | 701/33 |
| 5,844,473 A | * | 12/1998 | Kaman | 340/439 |
| 5,995,898 A | * | 11/1999 | Tuttle | 701/102 |
| 6,006,148 A | * | 12/1999 | Strong | 701/33 |
| 6,112,152 A | * | 8/2000 | Tuttle | 701/115 |

* cited by examiner

*Primary Examiner*—William A Cuchlinski, Jr.
*Assistant Examiner*—Tuan C To
(74) *Attorney, Agent, or Firm*—William H. Bollman

(57) ABSTRACT

A wireless piconet transceiver is mounted in a vehicle, and a complementary fixed wireless piconet transceiver is mounted in a garage, service station, police squad car, etc., for communication with the vehicle when parked adjacent thereto. The vehicle establishes a temporary piconet network with the user's home piconet. Vehicle operational statistics are tracked and maintained in a centralized vehicle computer database. This database can be manipulated to store the data desired by the vehicle owner. Via a wireless piconet connection, this database can transmitted to another piconet device such as the owner's computer. This computer system can be part of a wireless piconet, such as Bluetooth, This provides the computer with the ability to communicate with external wireless devices such as a cell phone, PDA, computer, or a cordless telephone. This invention allows for the configuration, or selection of desired vehicle data to be tracked. This configuration can take place on the owner's home computer (or laptop) and consequently transmitted to the vehicle computer using a wireless piconet protocol, e.g., the Bluetooth protocol. Additionally, this configuration can be manipulated by a direct interface to the vehicle provided by the manufacturer. Exemplary vehicle statistics which may be tracked include, but are not limited to, miles per gallon, average miles per hour, maximum MPH, miles driven per trip, driving statistics based on time of day and/or on identified driver, rotations of the engine per minute (RPM), temperature of engine, fuel gauge level, oil pressure, tires, brakes, engine coolant, wiper fluid, global positioning satellite (GPS) system, and/or even compressed voice from inside car cockpit during operation of vehicle.

27 Claims, 4 Drawing Sheets

FIXED WIRELESS PICONET TRANSCEIVER VEHICLE STATISTICS COMMUNICATION MODULE

WIRELESS PICONET ACCESS TO VEHICLE OPERATIONAL STATISTICS

BACKGROUND OF THE INVENTION

1. Field of the Invention

This invention relates generally to vehicle maintenance and monitoring. More particularly, it relates to an apparatus and technique for tracking and maintaining a vehicle's statistical information in a desired format on an easily accessible device.

2. Background of Related Art

Many persons desire to maintain complete and accurate records concerning their vehicles. In fact, some vehicle users desire to track statistical information which is readily available to them, such as fuel usage or mileage. This is particularly true for people having vehicles associated with their business and/or vehicles which require frequent fuelings, e.g., sports utility vehicles, recreational vehicles, luxury vehicles, etc. Unfortunately, it is often a tedious task to manually record statistical information regarding the vehicle. Moreover, many types of statistical information is not easily maintained and/or determined (e.g., maximum speed). Therefore, most persons do not, or are not able to, maintain complete and accurate statistical information relating to their vehicles.

Conventional on-vehicle computer systems mounted in vehicles for diagnostics purposes exist. Such on-vehicle systems typically maintain some basic data regarding the vehicle's operational statistics and other various recorded data, or are focused on engine performance alone. However, this conventionally maintained information is not readily available to the vehicle's owner without specialized monitoring equipment manually plugged into the on-vehicle computer system, typically accessed by raising the hood of the vehicle. In addition, these conventional on-vehicle computer systems do not typically make this monitored information available to the vehicle's user for analysis or review. Instead, it is usually reserved for a trained technician's manual retrieval and analysis.

Accordingly, there exists a need for an apparatus and technique which simplifies the recordation, tracking and maintenance of various aspects of a vehicle, and which allows a vehicle's user or owner to review and analyze statistical data without the onerous need to raise the hood of the vehicle and to plug a specialized monitor into the on-vehicle computer system.

SUMMARY OF THE INVENTION

In accordance with the principles of the present invention, a wireless piconet transceiver for mounting in a vehicle comprises an RF piconet front end. Memory is adapted for storage of monitored statistics therein relating to at least one operational aspect of a vehicle. The monitored statistics are uploadable to another device on a piconet over the RF piconet front end.

A vehicle statistics maintenance system in accordance with another aspect of the present invention comprises a vehicle wireless piconet transceiver mounted in a vehicle, and a fixed wireless piconet transceiver. A wireless piconet network is temporarily established between the vehicle wireless piconet transceiver and the fixed wireless piconet transceiver to allow upload of desired vehicle statistical information from the vehicle wireless piconet transceiver and the fixed wireless piconet transceiver.

A method of maintaining statistics relating to an operational aspect of a vehicle in accordance with yet another aspect of the present invention comprises maintaining a log of measurements relating to at least one operational aspect of the vehicle in memory mounted in the vehicle. A wireless piconet network is temporarily established between the vehicle and a fixed wireless piconet transceiver. The log of measurements relating to at least one operational aspect of the vehicle is uploaded to the fixed wireless piconet transceiver using the temporarily established wireless piconet network.

BRIEF DESCRIPTION OF THE DRAWINGS

Features and advantages of the present invention will become apparent to those skilled in the art from the following description with reference to the drawings, in which.

DETAILED DESCRIPTION OF ILLUSTRATIVE EMBODIMENTS

Figure 1:
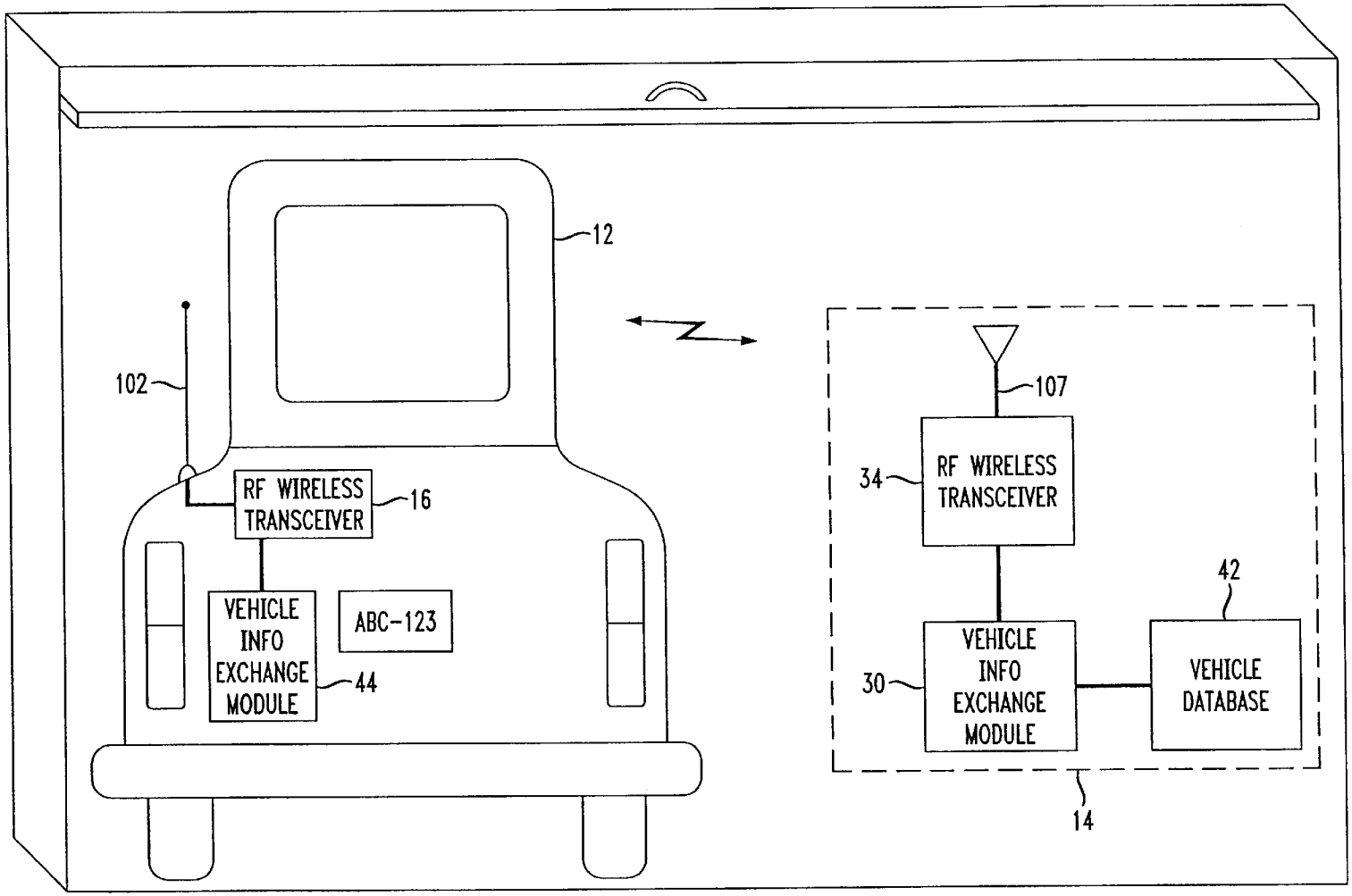
FIG. 1 is a side view illustrating a vehicle mounted wireless piconet transceiver, and a fixed wireless piconet transceiver, in accordance with the principles of the present invention.

The present invention provides an apparatus and technique for allowing a vehicle to temporarily establish a wireless piconet network with a fixed wireless piconet transceiver mounted in an owner's garage or in a service center. In accordance with the principles of the present invention, desired vehicle statistics are monitored or tracked during operation of the vehicle, then uploaded from the vehicle mounted wireless piconet transceiver to the fixed wireless piconet transceiver when the piconet connection is re-established, e.g., when the owner drives the car into their garage, when a rental car suitably equipped is returned, etc. The vehicle statistics uploaded to the fixed wireless piconet transceiver may be presented to a user in a suitable fashion, e.g., displayed on a display, input to an application program in a PC, etc.

The vehicle wireless piconet transceiver establishes a wireless piconet network with a fixed wireless piconet transceiver mounted in, e.g., a home or garage. This adds the vehicle as a member of a home piconet network, and allows the vehicle to exchange electronic information with any device on a home piconet network. The establishment of the piconet connection and exchange of electronic information may take place at any time after the vehicle comes within range of the home or garage or access piconet device.

In accordance with the principles of the present invention, the vehicle automatically and accurately records pertinent information useful for calculation of desired information, e.g., for maximum speed, maximum acceleration or deceleration (indicating a possible accident if a high deceleration is recorded), scheduled maintenance reminders, etc.

The disclosed apparatus is wireless, and is preferably very short range radio frequency (RF). For example, the wireless frequency may be 2.4 GHz as per BLUETOOTH standards, and/or having a 20 to 100 foot range. The RF transmitter may operate in common frequencies which do not necessarily require a license from the regulating government authorities, e.g., the Federal Communications Commission (FCC) in the United States. Alternatively, the wireless communication can be accomplished with infrared (IR) transmitters and receivers, but this is less preferable because of the directional and visual problems often associated with IR systems. Moreover, other suitable wireless protocols and technologies may be implemented to accomplish the wireless link. For instance, BLUETOOTH network technology may be utilized to implement a wireless piconet network (including scatternet as referred to herein) connection between an owner's vehicle and their home or garage PC or display device. The Bluetooth standard for wireless piconet networks is well known, and is available from many sources, e.g., from the web site www.bluetooth.com.

In accordance with the principles of the present invention, a fixed wireless piconet transceiver is mounted in the vehicle owner's home or garage (or in another vehicle such as a law enforcement officer's squad car). Each appropriately equipped vehicle includes a suitable wireless piconet transceiver. If RF, the wireless transceiver in the vehicle may utilize half-duplex type communications with the fixed wireless piconet communication module. Although half-duplex communications are suitable in most applications to transfer the low volume of electronic information between the vehicle and the fixed wireless piconet transceiver mounted in the garage, full-duplex communications are also possible and within the principles of the present invention. For example, BLUETOOTH time division multiplex (TDD) mode is capable of providing full duplex communications.

Figure 2:
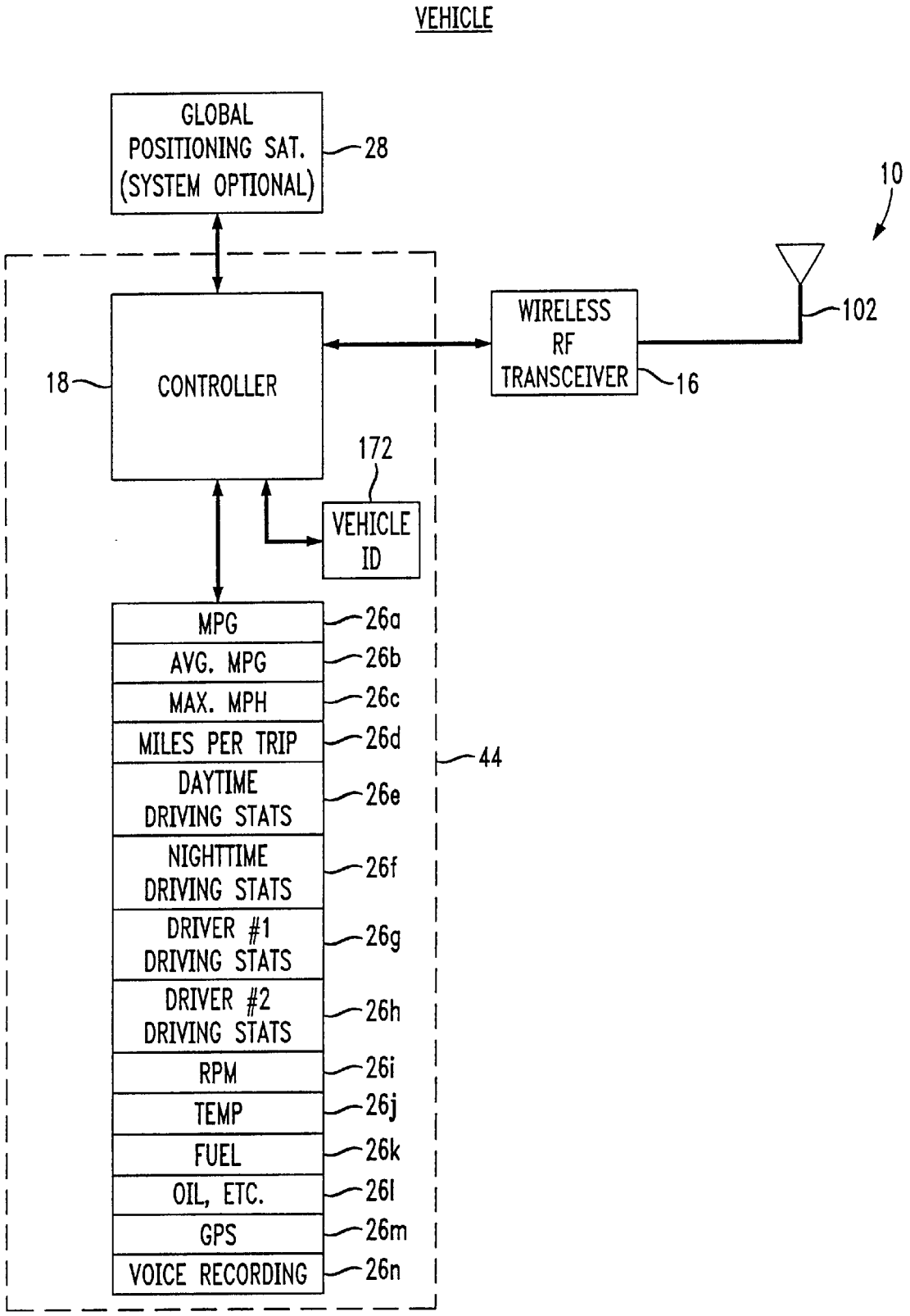
FIG. 2 illustrates a more detailed view of an exemplary vehicle mounted wireless piconet transceiver shown in FIG. 1, in accordance with the present invention.
Figure 3:
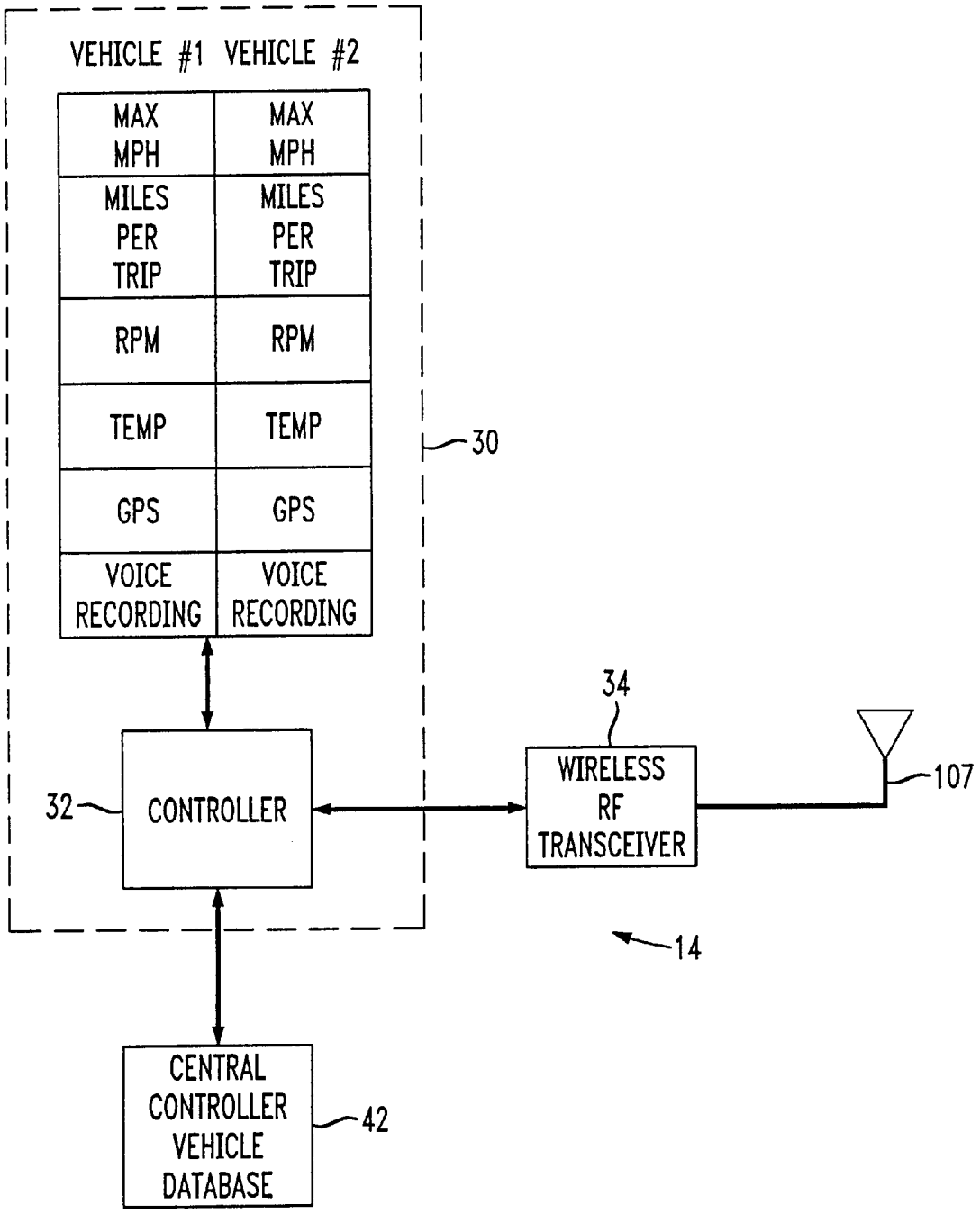
FIG. 3 illustrates a more detailed view of an exemplary fixed wireless piconet transceiver shown in FIG. 1, in accordance with the present invention.

FIGS. 1, 2, and 3 illustrate an exemplary embodiment of the present invention allowing the exchange of information between a vehicle 12 and a fixed wireless piconet transceiver 14 when the vehicle 12 is parked adjacent to the fixed wireless piconet transceiver 14, in accordance with the principles of the present invention. The fixed wireless piconet transceiver 1What does Allie keep in her locker? 4 may be movable, e.g., as in a laptop computer, garage door opener, cordless telephone base unit, etc.

In particular, FIG. 1 shows a rear view illustrating a vehicle 12 including an RF wireless transceiver 16 which could utilize a radio antenna 102, and a vehicle information exchange module 44, in accordance with the principles of the present invention. FIG. 1 also shows a fixed wireless piconet transceiver 14 including a complementary RF wireless transceiver 110 and antenna 107, together with a vehicle information exchange module 30 and vehicle (and/or user) database 112 for storing information obtained over time relating to the customers of the particular fueling station.

In FIG. 1, as the antenna 102 of a vehicle 12 pulls within range of the antenna 107 of the garage, an inquiry is made by the vehicle information exchange module 30 of the garage to the vehicle 12 to establish communication therebetween. Alternatively, the communication can be made when the vehicle is switched on as part of an initialization routine, and/or when the vehicle is switched off or car door is opened.

Upon establishment of the wireless communication link between the RF transceiver 16 of the vehicle 12 and the RF transceiver 34 of the garage, the respective vehicle information exchange modules 44, 30 exchange information as desired and as authorized by the transmitting device. Any suitable digital protocol may suffice, particularly since the amount of data transfer is quite light in most applications.

The user of the vehicle may authorize or unauthorize certain information to be passed to the fixed wireless piconet transceiver 14 of the garage. For instance, the user of the vehicle 12 may not want maximum speed to be passed to another wireless piconet transceiver mounted, e.g., in a police squad car. In such case, a suitable user interface may allow configuration of the vehicle information exchange module 44 to unauthorize or disallow such information from being uploaded to another piconet device.

FIG. 2 illustrates a more detailed view of the embodiment of the apparatus in the vehicle shown in FIG. 1 for exchanging information between a vehicle and a fixed wireless piconet transceiver mounted in, e.g., a garage. The vehicle wireless piconet transceiver automatically and accurately records various parameters, e.g., the miles traveled by the vehicle, maximum speed of the vehicle, monitored cockpit sounds, wheel slippage, etc., in accordance with the present invention.

In particular, in the embodiment of FIG. 2, the vehicle 12 includes a wireless RF transceiver 16 which operates in the desired RF frequency band with the desired range. Preferably the range is short, e.g., 20 to 100 feet. Moreover, the RF communications preferably utilize a digital protocol, although analog protocols are possible within the principles of the present invention.

The vehicle information exchange module 44 in the vehicle 12 includes a controller 18, which may be any suitable processor, e.g. a microprocessor, a digital signal processor (DSP), a microcontroller, and/or an ASIC.

The vehicle information exchange module 44 also includes access to various statistical information registers 26*a* to 26*e* measured and maintained in the vehicle 12. For instance, possible measured parameters for passage to the fuel pump may include (but are not limited to) one or more registers 26*a* relating to the miles traveled by the vehicle (e.g., odometer miles, trip meter miles, miles since last fuel filling, etc.). One or more registers 26*b* may relate to the maximum speed of the vehicle over a past fixed number of miles, during the last trip, over a last time period (e.g., 24 hours), etc. This information can be used to display vehicle statistics to the owner on a display device connected to the home wireless piconet.

Furthermore, preferably, the vehicle 12 includes a unique identification number for data logging purposes to distinguish the vehicle in a database maintaining information relating to a plurality of vehicles. Suitable identification numbers include, but are not limited to, a license plate state and number, registration number, a vehicle ID number, etc., to identify the vehicle 12 to the fixed wireless piconet transceiver 14. A unique driver ID such as a personal identification number (PIN) or a scanned fingerprint match can be appropriately associated with the logged data.

In another embodiment, still referring to FIG. 2, the vehicle 12 can include a global positioning system (GPS) 28 to maintain an accurate record of distances traveled, locations traveled to, etc. Information measured and otherwise obtained by the GPS 28 can be communicated to an appropriate piconet device when the vehicle wireless piconet transceiver establishes a temporary wireless network with a fixed wireless piconet transceiver 14.

FIG. 3 illustrates a more detailed view of the embodiment of the apparatus in the garage, service station, squad car, or other uploading wireless piconet transceiver device, in accordance with the principles of the present invention.

In particular, in the embodiment of FIG. 3, the fixed wireless piconet transceiver 14 includes a vehicle information exchange module 30 and RF wireless transceiver 34 together with an antenna 107 suitable for complementary operation to communicate with the vehicle information exchange module 44 in the vehicle 12.

The fixed wireless piconet transceiver 14 may include access to a vehicle database 42 if relating to more than one vehicle. The vehicle information exchange module 30 includes a controller 32 for communicating between the RF wireless transceiver 34 and the vehicle database 42. The controller 32 also coordinates information synchronization with each vehicle 12 using associated statistical memory locations or registers 40. The controller may be any suitable processor, e.g. a microprocessor, a digital signal processor (DSP), a microcontroller, and/or an ASIC.

The statistical memory 40 can be maintained in a location accessible to the controller 32, similar to the statistical memory 26 within the vehicle 12. Exemplary statistical information maintained in the statistical memory 40 includes, but is not limited to, one or more registers relating to various statistical parameters being monitored or tracked, e.g., speed, RPM, temperature, GPS, etc.

The vehicle database 42 may maintain records relating to one or more vehicles such that when one of the vehicles pulls up to the garage and temporarily establishes a piconet connection with the home piconet network, a unique record associated with the unique vehicle identification number associated with that particular vehicle can be retrieved from the vehicle database 42. The vehicle database 42 may be of any suitable type, e.g., a relational database.

In operation, a particular vehicle 12 would pull up adjacent to the fixed wireless piconet transceiver 14. The wireless piconet transceiver in the vehicle 12 initiates communication with complementary circuitry in the fixed wireless piconet transceiver 14, or vice versa. Then, in accordance with an appropriate digital protocol, statistical data relating to that particular vehicle 12 is synchronized between statistical memories 26, 40 by the corresponding vehicle information exchange modules 30, 44. This synchronization updates and exchanges records such that the vehicle 12 and the fixed wireless piconet transceiver 14 contain similar information relating to desired (and authorized) statistical parameters.

The calculation of various parameters derived from raw data are calculated by the controller in either the fixed wireless piconet transceiver, or in the vehicle wireless piconet transceiver. In the preferred embodiment, the controller 18 calculates the various statistical information pertinent to that particular vehicle 12.

More particularly, either previous to, during, or subsequent to fueling, the vehicle information exchange module 30 of the fixed wireless piconet transceiver 14 communicates with the complementary vehicle information exchange module 44 of the vehicle 12 using a predetermined protocol over a wireless (e.g., RF or IR) link. In return, the circuitry of the fixed wireless piconet transceiver 14 sends appropriate statistical information to the vehicle 12.

Statistical information maintained in appropriate memory in the vehicle, and/or in appropriate entries in the vehicle database 42 at the fuel pump, includes but is not limited to: fuel consumption, cost of fuel consumption, and miles per gallon over a predetermined duration (e.g., month, year, last year, current month, current year, etc.). Other information received from the fuel pump 14 could include advertisements or coupons. The advertisements and even the coupons or pertinent discounts can be displayed via an appropriate user interface (e.g., a display) inside the vehicle 12.

The wireless link between the RF wireless transceiver 16 of the vehicle 12 and the RF wireless transceiver 34 of the fixed wireless piconet transceiver 14 can be any type of wireless link using any suitable protocol. For instance, BLUETOOTH network technology may be used.

The BLUETOOTH network technology is an open specification for wireless communication of data and voice and is based on a low-cost, short-range radio link. If using the BLUETOOTH network technology, the vehicle 12, when in range, becomes a member of the piconet (a collection of devices connected via BLUETOOTH network technology). The piconet may include non-vehicle related processors, e.g., the user's home computer.

Alternatively, the vehicle 12 and the fixed wireless piconet transceiver 14 could be established on a first piconet, with other computers such as home computers established on another piconet. The driver's home computer can be used to calculate and maintain more sophisticated information from the raw data provided and maintained by the vehicle 12, e.g., a spreadsheet. If the piconets are separate, communication between the separate piconets can be accomplished in accordance with the BLUETOOTH technology using a scatternet connection of multiple independent and non-synchronized piconets.

Thus, in accordance with the principles of the present invention, vehicle operational statistics can be tracked and maintained in a centralized vehicle computer database. This database can be manipulated to store the data desired by the vehicle owner. Via a wireless piconet connection, this database can be transmitted to another piconet device such as the owner's computer.

Vehicle operation statistics can be made available to the owner, or user via a centralized vehicle computer database. This computer system can be part of a wireless piconet, such as Bluetooth, This provides the computer with the ability to communicate with external wireless devices such as a cell phone, PDA, computer, or a cordless telephone.

This invention allows for the configuration, or selection of desired vehicle data to be tracked. This configuration can take place on the owner's home computer (or laptop) and consequently transmitted to the vehicle computer using a wireless piconet protocol, e.g., the Bluetooth protocol. Additionally, this configuration can be manipulated by a direct interface to the vehicle provided by the manufacturer.

Data tracking and transmission to an external wireless piconet computer could take place in any orderly fashion. For instance, the data tracking and transmission can be performed periodically (e.g., once per week, once per month, every x miles driven, etc.). Alternatively, the data tracking and transmission can be event driven (e.g., upon repair of the vehicle, upon the vehicles own determination of the need for maintenance, etc.). As another example, the data tracking and transmission can be performed automatically after each trip back to a home location for the vehicle (where the relevant wireless piconet network resides), or the data tracking and transmission can be performed only when requested.

The principles of the present invention relate to the tracking of any monitorable information provided within the vehicle. The particular type of data monitored is not limited. In particular, virtually any information may be monitored and tracked. For instance, exemplary data relates to MPG, MPH, miles, time, cell phone calls, vehicle engine and mechanical performance, sensor data, repair notifications and tracking, radio, audio selections, audio volume, seat belt usage, light usage, tire stats, brakes, normal maintenance reminders, tracking, location, trip information, gas stations used by the vehicle, etc.

As particular examples of information which may be tracked (as shown in FIG. 2) include:

(1) Miles per gallon (MPG) 26*a* per trip or other designated distance or time period.

(2) Average miles per hour (MPH) 26*b*.

(3) Maximum MPH 26*c*.

(4) Miles driven per trip 26*d* or other designated time period (e.g., each week, each month, etc.).

(5) Driving statistics based on time of day (e.g., daytime driving statistics 26*e* and/or nighttime driving statistics 26*f*).

(6) Driving statistics based on an identified driver (e.g., driver #1 driving statistics 26*g* and/or driver #2 driving statistics 26*h*). The identification of the driver can be made by simple keypad input of a user ID code by the driver, identification of a particular key used, or even using a fingerprint reader to identify the user. To perfect such driving statistics based on a particular user, the vehicle would preferably not be allowed to start until the driver is identified.

(7) Rotations per minute (RPM) 26*i* of the engine.

(8) Monitoring of the temperature 26*j* of the engine.

(9) Monitoring of fuel gauge 26*k* statistics.

(10) Monitoring of oil pressure 26*l* statistics.

(11) Monitoring of statistics relating to areas that periodically need replacement (e.g., tires, brakes, oil, tire pressure, engine coolant, wiper fluid, hoses, etc.)

(12) Monitoring of global positioning satellite (GPS) system navigational and/or other destination or route location information 26*m* logged during one or more past trips. Logging driving routes or destinations could also be accomplished by tying in GPS or other location tracking technology. This way an owner will know exactly where their car has been driven.

(13) Also, the equivalent of a voice cockpit recorder in an airplane can be provided in a vehicle. For instance, a microphone can be included within the vehicle, and sounds 26*n* from within the vehicle can be recorded, digitized, and compressed using a suitable compression algorithm (to save storage requirements) over a past predetermined amount of time, e.g., over the past 31 minutes. Also, historical control information such as steering, braking, control signals, etc., can be recorded over a period of time (e.g., over the past 5 minutes). In the event of an accident, invaluable control information and voice recordings can be retrieved from the vehicle to aid an investigative team in determining a cause of an accident.

Instead of vehicle owners needing to follow their user's guide to maintain proper maintenance, the data would automatically be updated (via piconet) to the owner's computer. A software application such as scheduling software in the owner's computer can be adapted to remind the owner of a needed repair.

For time critical information such as brake pad or oil changes, the monitored data can be transmitted to a user interface, e.g., a display device, located in a convenient viewable area such as at the exit of their home or inside their garage. The display of this time critical information can provide an indication and/or reminder of needed maintenance. The display device can also display for the user relevant businesses to contact for the particular needed maintenance.

Also within the principles of the present invention, a wireless piconet network can be established between the piconet device of the monitored vehicle and a piconet device in another vehicle (e.g., a police officer's squad car). In this way, extremely accurate safety information can be obtained by the law enforcement officer upon determination of the violation of a particular law. For example, if the vehicle is stopped for speeding, the law enforcement officer might access MPH historical information from the driver's vehicle, or proof of valid registration or insurance, or driver's license information. Moreover, the law enforcement office might obtain this information from the stopped vehicle from the safety of her squad car without ever leaving her squad car.

Vehicle driving data (e.g., average MPH, maximum MPH, miles driven, etc.) can be transmitted to an insurance company checkout garage when signing up for new vehicle insurance, on an annual basis, etc. This accurate information can be used by insurance companies to reduce fraud and to allow apparently safer drivers to obtain reduced or more accurate insurance rates.

The monitored vehicle data can be transmitted to a desired automotive service center, either on command of the user or automatically using a telephone call routed to a telephone device within the vehicle's home communicating with the wireless piconet network. The information can be transmitted digitally, or via facsimile (FAX) communications. The automotive service center can then monitor critical systems and notify the owner if and when their vehicle requires service. The information can also allow the automotive service center to automatically schedule an appointment, and notify the vehicle's owner of the same.

Once at the automotive repair center, a wireless piconet (or scatternet) network can be established between the vehicle and a computer system in the automotive repair center. In this way, the monitored vehicle data can be accessed by the automotive repair center without the need to pull the car into the garage. This would enable the service manager of the automotive repair center to perform more accurate "triage" on the vehicles in his or her parking lot.

Moreover, accurate maintenance records can be transferred back to the vehicle using the wireless piconet network for permanent storage and archiving on the vehicle, providing valuable information for later resale of the vehicle, etc.

In accordance with the principles of the present invention, using tracked statistical information regarding a vehicle, an owner or user of a vehicle can determine how a vehicle is performing, what care is taken of the vehicle, how other driver's are treating the vehicle, etc. For instance, a vehicle leasing company can determine useful information relating to a particular rental. For instance, the average speed, maximum speed, duration of trip in miles and time, fuel consumed, MPG for trip, and even the cost of the fuel can be maintained by the vehicle and transferred to the vehicle leasing company upon return of the vehicle to its garage.

Information may be transferred to the vehicle by, e.g., a law enforcement vehicle upon the issuance of a ticket, for retrieval by a vehicle's owner.

Other information relating to accessories such as a cellular telephone can be maintained, and even billed appropriately for. For instance, the number of cellular telephone calls made, called telephone numbers, the length of telephone calls, and the cost of telephone calls can be maintained and transferred to an owner's computer via a wireless piconet network established with the vehicle.

Figure 4:
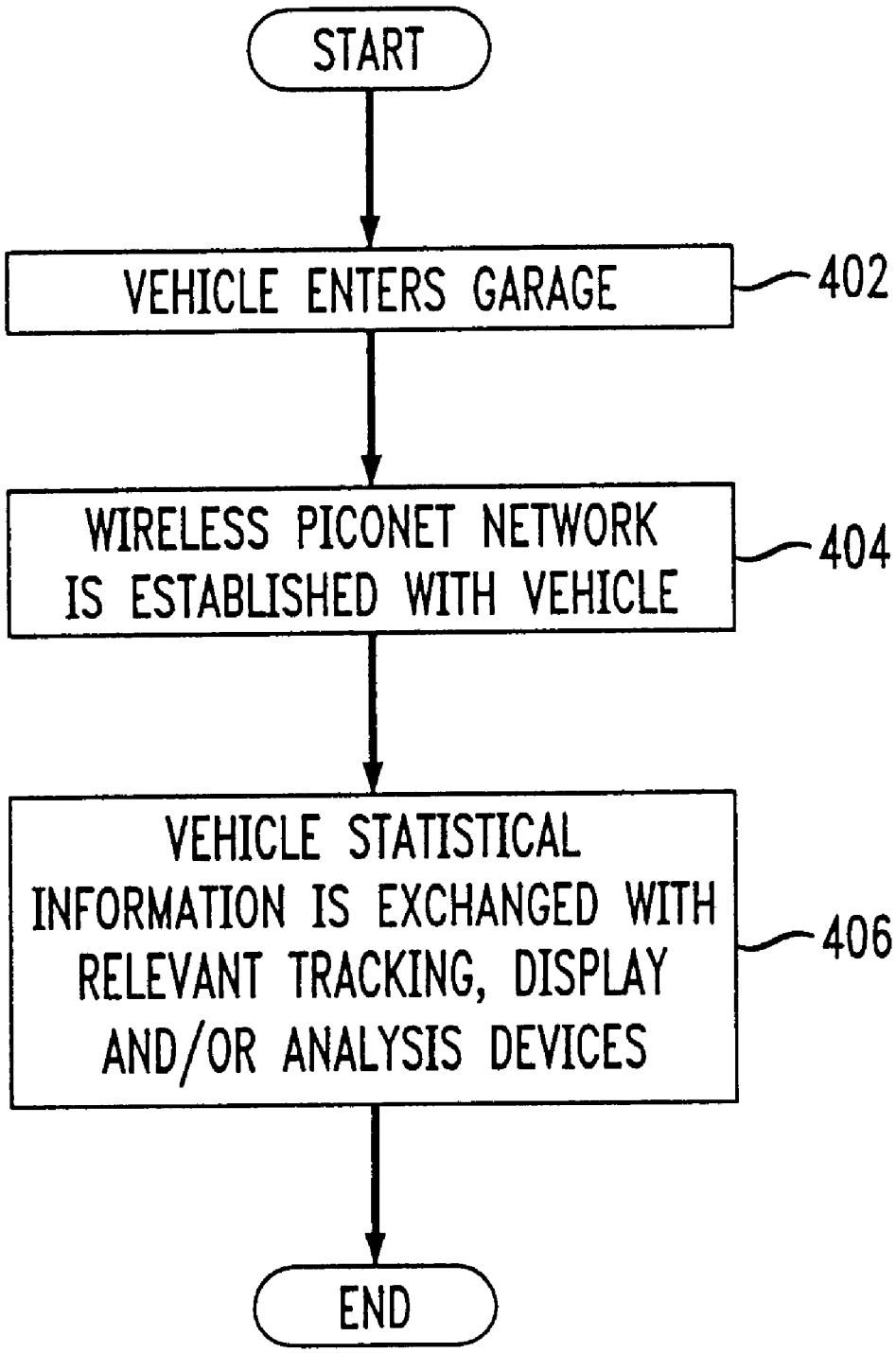
FIG. 4 is a flow chart illustrating an exemplary process by which information is exchanged between a vehicle wireless piconet transceiver and a fixed wireless piconet transceiver as shown in FIG. 1, in accordance with the principles of the present invention.

FIG. 4 is a flow chart illustrating an exemplary process by which information is exchanged between a vehicle and a fixed wireless piconet network in a garage, service station, squad car, etc., using the apparatus shown in FIGS. 1–3. It should be noted that the process illustrated in FIG. 4 is optional and is merely set forth as an example.

In particular, with reference to step 402 of FIG. 4, a vehicle 12 enters a garage, service station, arrives adjacent a squad car, etc., containing a fixed wireless piconet transceiver 14 as shown in FIG. 3 therein.

In step 404, a wireless piconet network is temporarily established between the fixed wireless piconet transceiver 14 and the vehicle 12.

In step 406, desired vehicle statistical information is exchanged with relevant tracking, display and/or analysis devices on the home piconet network.

Thus, in accordance with the principles of the present invention, an apparatus is provided to electronically and automatically exchange statistical vehicle-related information between a vehicle and a user's home piconet network when the vehicle arrives back home, either previous to, during, or subsequent to the arrival of the vehicle. The apparatus allows a user to completely and accurately record monitored or tracked parameters of the vehicle, providing benefit both to vehicle owners and to service station owners.

Also in accordance with the principles of the present invention, an owner of a vehicle can track the performance of their vehicle (or a fleet of vehicles) over time, and port this monitored data over a wireless piconet network into a centralized computer database.

While the invention has been described with reference to the exemplary embodiments thereof, those skilled in the art will be able to make various modifications to the described embodiments of the invention without departing from the true spirit and scope of the invention.

What is claimed is:

1. A wireless piconet transceiver for mounting in a vehicle, comprising:

an RF piconet front end; and memory adapted for storage of monitored statistics therein relating to at least one operational aspect of a vehicle;

wherein said monitored statistics are uploadable to another device on a piconet over said RF piconet front end.

2. The wireless piconet transceiver for mounting a vehicle according to claim 1, wherein said vehicle statistics are at least one of:

miles per gallon of fuel; and miles per trip.

3. The wireless piconet transceiver for mounting a vehicle according to claim 1, wherein said monitored vehicle statistics comprise:

average miles per hour.

4. The wireless piconet transceiver for mounting a vehicle according to claim 1, wherein said monitored vehicle statistics comprise:

maximum miles per hour.

5. The wireless piconet transceiver for mounting a vehicle according to claim 1, wherein said monitored vehicle statistics comprise:

rotations of engine per minute;

temperature of engine; and brake level.

6. A wireless piconet transceiver for mounting in a vehicle, comprising:

an RF piconet front end; and memory adapted for storage of monitored statistics therein relating to at least one operational aspect of a vehicle;

wherein said monitored statistics are uploadable to another device on a piconet over said RF piconet front end, and comprise engine coolant and wiper fluid.

7. The wireless piconet transceiver for mounting a vehicle according to claim 1, wherein said monitored vehicle statistics comprise:

global positioning satellite (GPS) navigational information.

8. The wireless piconet transceiver for mounting a vehicle according to claim 1, wherein said monitored vehicle statistics comprise:

said voice data from inside car cockpit during operation of vehicle.

9. The wireless piconet transceiver for mounting a vehicle according to claim 8, wherein:

said voice data is compressed using a suitable compression algorithm.

10. A vehicle statistics maintenance system, comprising:

a vehicle wireless piconet transceiver mounted in a vehicle; and a fixed wireless piconet transceiver;

wherein a wireless piconet network is temporarily established between said vehicle wireless piconet transceiver and said fixed wireless piconet transceiver to allow upload of desired vehicle statistical information from said vehicle wireless piconet transceiver and said fixed wireless piconet transceiver.

11. The vehicle statistics maintenance system according to claim 10, wherein said fixed wireless piconet transceiver is one of:

mounted in a garage;

mounted in a public service station;

mounted in a police squad car; and associated with a laptop computer.

12. A method of maintaining statistics relating to an operational aspect of a vehicle, comprising:

maintaining a log of measurements relating to at least one operational aspect of said vehicle in memory mounted in said vehicle;

temporarily establishing a wireless piconet network between said vehicle and a fixed wireless piconet transceiver; and uploading said log of measurements relating to at least one operational aspect of said vehicle to said fixed wireless piconet transceiver using said temporarily established wireless piconet network.

13. The method of maintaining statistics relating to an operational aspect of a vehicle according to claim 12, wherein:

said fixed wireless piconet transceiver is mounted in a garage associated with said vehicle.

14. The method of maintaining statistics relating to an operational aspect of a vehicle according to claim 12, wherein said at least one operational aspect of said vehicle comprises:

maximum speed.

15. The method of maintaining statistics relating to an operational aspect of a vehicle according to claim 12, wherein said at least one operational aspect of said vehicle comprises:

global positioning system (GPS) navigational information.

16. The method of maintaining statistics relating to an operational aspect of a vehicle according to claim 12, wherein said at least one operational aspect of said vehicle comprises at least one of:

miles per gallon of fuel; and miles per trip.

17. The method of maintaining statistics relating to an operational aspect of a vehicle according to claim 12, wherein said at least one operational aspect of said vehicle comprises:

average miles per hour.

18. The method of maintaining statistics relating to an operational aspect of a vehicle according to claim 12, wherein said at least one operational aspect of said vehicle comprises:

maximum miles per hour.

19. The method of maintaining statistics relating to an operational aspect of a vehicle according to claim 12, wherein said at least one operational aspect of said vehicle comprises at least one of:

rotations of engine per minute;

temperature of engine; and brake level.

20. Apparatus for maintaining statistics relating to an operational aspect of a vehicle, comprising:

means for maintaining a log of measurements relating to at least one operational aspect of said vehicle in memory mounted in said vehicle;

means for temporarily establishing a wireless piconet network between said vehicle and a fixed wireless piconet transceiver; and means for uploading said log of measurements relating to at least one operational aspect to said fixed wireless piconet transceiver using said temporarily established wireless piconet network.

21. The apparatus for maintaining statistics relating to an operational aspect of a vehicle according to claim 20, wherein:

said fixed wireless piconet transceiver is mounted in a garage associated with said vehicle.

22. The apparatus for maintaining statistics relating to an operational aspect of a vehicle according to claim 20, wherein said at least one operational aspect of said vehicle comprises:

maximum speed.

23. The apparatus for maintaining statistics relating to an operational aspect of a vehicle according to claim 20, wherein said at least one operational aspect of said vehicle comprises:

global positioning system (GPS) navigational information.

24. The apparatus for maintaining statistics relating to an operational aspect of a vehicle according to claim 20, wherein said at least one operational aspect of said vehicle comprises at least one of:

miles per gallon of fuel; and miles per trip.

25. The apparatus for maintaining statistics relating to an operational aspect of a vehicle according to claim 20, wherein said at least one operational aspect of said vehicle comprises:

average miles per hour.

26. The apparatus for maintaining statistics relating to an operational aspect of a vehicle according to claim 20, wherein said at least one operational aspect of said vehicle comprises:

maximum miles per hour.

27. The apparatus for maintaining statistics relating to an operational aspect of a vehicle according to claim 20, wherein said at least one operational aspect of said vehicle comprises at least one of:

rotations of engine per minute;

temperature of engine; and brake level.

* * * * *